US007328833B1

(12) United States Patent
Wiley

(10) Patent No.: US 7,328,833 B1
(45) Date of Patent: Feb. 12, 2008

(54) FOLDABLE, KNOCKDOWN PALLET CONTAINER

(76) Inventor: Teddy E. Wiley, 1507 Linker Mountain Rd., Dover, AR (US) 72837

( * ) Notice: Subject to any disclaimer, the term of this patent is extended or adjusted under 35 U.S.C. 154(b) by 664 days.

(21) Appl. No.: 10/857,077

(22) Filed: May 28, 2004

(51) Int. Cl.
*B65D 5/36* (2006.01)
*B65D 5/00* (2006.01)

(52) U.S. Cl. ..... 229/117.05; 229/110; 229/122.21; 229/108.1

(58) Field of Classification Search ..... 229/117.05, 229/110, 113, 117, 120.11, 122.28, 125.26, 229/122.21
See application file for complete search history.

(56) References Cited

U.S. PATENT DOCUMENTS 1,555,054 A * 9/1925 Berkowitz ..... 229/108.1
1,792,370 A 2/1931 Goodman
2,019,787 A 11/1935 Leopold
2,120,871 A 6/1938 Rudowitz
2,741,416 A 4/1956 Hileman
2,922,562 A * 1/1960 Pellaton ..... 229/110
3,101,167 A 8/1963 Styler
3,174,675 A 3/1965 Rosenburg, Jr.
3,423,008 A 1/1969 Mykleby
3,581,974 A 6/1971 Freeman
4,089,417 A 5/1978 Osborne
4,119,266 A 10/1978 Dempster
4,166,567 A * 9/1979 Beach et al. ..... 229/108.1
4,264,031 A 4/1981 Goebel
4,313,556 A 2/1982 Boyle
4,341,337 A 7/1982 Beach
4,736,885 A 4/1988 Negus, Sr.
4,927,026 A 5/1990 Gossler
4,948,035 A 8/1990 Wischoff
4,976,353 A 12/1990 Halliday
5,445,315 A 8/1995 Shelby
5,484,100 A 1/1996 Rigby
5,715,991 A 2/1998 Gasper
5,921,465 A * 7/1999 Garton ..... 229/109
6,290,123 B1 * 9/2001 Pei ..... 229/117

* cited by examiner

*Primary Examiner*—Nathan J. Newhouse
*Assistant Examiner*—Christopher Demeree
(74) *Attorney, Agent, or Firm*—Stephen D. Carver

(57) ABSTRACT

A heavy-duty pallet box for bulk goods and palletized loads. The knockdown box may be folded for storage. To erect it, a flat board comprising a pair of complementary, die-cut blanks, or a unitary blank comprising complementary halves, is unfolded. A central side panel and a pair of adjacent, foldable side panels on each blank are separated by score lines for folding. Suitable flaps project from each blank for gluing them together. A lower, generally trapezoidal segment is formed at each blank bottom, below the central panel. The latter segments, one from each of two blanks, are coupled to form the knockdown bottom of the desired foldable container. Smaller trapezoidal flanges project downwardly from each blank at opposite sides of the larger trapezoidal segment. These flanges include suitable glue tabs. When assembled, the flanges form a shelf that braces the container bottom, reinforcing the structure.

4 Claims, 16 Drawing Sheets

FOLDABLE, KNOCKDOWN PALLET CONTAINER

BACKGROUND OF THE INVENTION

I. Field of the Invention

The present invention relates generally to automatically deployable cartons or boxes for containing and packaging various goods. More particularly, the present invention relates to heavy-duty corrugated pallet boxes that can be stored flatly until use, whereupon they are deployed simply by unfolding. Known prior art germane to my invention is classified in United States Patent Class 224, Subclasses 108, 108.1, 109, and 110.

II. Description of the Prior Art

Numerous different corrugated containers have been proposed over the years for confining and protecting heavy or bulky palletized loads. Wooden pallets are in widespread use in relatively unfriendly industrial or warehouse environments, where they are stacked upon one another until use, and thereafter forcibly manipulated and moved about by powerful fork-lift trucks. During transit, these heavily laden pallets are routinely subjected to mechanical stresses and shocks as they are aggressively and sometimes carelessly moved about during typical loading and unloading operations. A variety of heavy duty, corrugated boxes have been designed strictly for pallet use. Many of these fold together and have a plurality of locking straps or flaps that interconnect with portions of the pallet. Most have some form of base that engages the pallet, with an uptight, generally tubular body that is polygonal in shape, with octagonal and hexagonal configurations being the most common.

Many common, large-capacity pallet boxes must be inverted before unfolding. Either the box must be handled by two workers, or one worker must push it against a wall or similar stationary object to force it to deploy. Typically, six to eight flaps must be manually aligned and interfitted, with two or more major flaps on the bottom locking the device together. Once the main bottom flaps are locked, the box is turned over for use. Some boxes of this description are so flimsy that the mere act of flipping them over forces the box apart, necessitating re-assembly prior to loading. Pallet boxes used in various food industries are provided with plastic liner bags prior to filling. After the moisture-proof bag is properly placed inside the pallet box the container may be filled with a thousand or more pounds of meat product such as chicken, beef, or pork. Such heavy loads are routine in the industry, and container damage, and in some cases failure resulting in spillage, are not uncommon events.

Many foldable, corrugated pallet boxes exist in the prior art. U.S. Pat. No. 2,922,562 issued Jan. 26, 1960 to E. C. Pellaton, entitled Polygonal Carton Construction, shows a collapsible carton with folding side walls that is adapted for foldable erection from a flat, collapsed storage state. The carton may be unfolded from a flat, collapsed blank useful during transportation and storage to the job site whereupon deployment is accomplished through unfolding. The box has a cross-sectional shape of a regular hexagon and has a so-called automatic bottom structure. Upon erecting the carton, the bottom structure and side walls thereof automatically assume their proper position without requiring the application of any setting up force to the interior of the carton to effect proper positioning of the bottom structure relative to the side walls. U.S. Pat. No. 2,922,562 This reference is the closest prior art known to me. However, modern machines that could build this type of pallet box are impractical and inordinately expensive. Although this design is a self-erecting, because of the way that it is glued, the deployed box, lacks strength. Because of it's one piece nature it cannot handle large loads, and it is not practical for bulk packaging.

U.S. Pat. No. 4,089,417 issued to Osborne on May 16, 1978 shows a heavy duty, octagonal pallet container with an upright, tubular body portion comprising a plurality of outer side walls. An inner liner is cut and scored to correspond to the octagonal shape of the container. Although this design can be manually folded, it has a separate piece that has to be interlocked into the bottom, which complicates and slows down deployment.

U.S. Pat. No. 4,119,266 issued to Dempster on Oct. 10, 1978 shows an octagonal shaped pallet box for use with heavy, palletized loads of meat products. Folded side panels and corner panels that are interengaged with suitable tabs form the bottom wall.

U.S. Pat. No. 4,166,568 issued to Swan Sep. 4, 1979 shows a polygonal pallet container foldably formed from a unitary blank of corrugated material. A plurality of rectangular side panels forms the tubular enclosure. Lower edge flaps interlock with mating flaps on the container bottom assembly. Designs of this general type that seek to build in some skid panels require too much raw materials (i.e., corrugated board) and they are too expensive for today's market.

U.S. Pat. No. 4,146,169 issued to Meyers on Mar. 27, 1979 shows a folding paperboard carton with a self-locking bottom wall panel structure, and multiple hinged side wall panels. The bottom wall panel structure a first bottom wall panel hinged to one of the confronting first side wall panels, and a second bottom wall hinged to the other of the confronting first side wall panels.

U.S. Pat. No. 4,199,098 issue to Lopez on Apr. 22, 1980 shows a polygonal bulk container that is collapsible to a flat storage condition. The tubular body has a plurality of rectangular panels hinged together to yield a polygonal cross-section.

U.S. Pat. No. 4,313,556 issued to Boyle on Feb. 2, 1982 discloses a one-piece carton blank that can be shipped and stored flatly and then unfolded. Numerous cooperating panels unfold as the side panels are pressured. This type of design does not functions adequately for heavy duty pallet loads common to bulk packaging.

U.S. Pat. No. 4,341,337 issued to Beach, Jr. on Jul. 27, 1982 shows a polygonal pallet container having a separate tubular section and bottom. This design requires extra flaps that must be manually glued to the outside to hold large loads. The requirement of a separate machine for gluing external flaps at the job site to the outside of an existing box makes the design commercially impractical.

U.S. Pat. No. 4,736,885 issued to Negus, Sr. on Apr. 12, 1988 shows a large, hexagonal bulk container comprising a plurality of rectangular panels hingedly connected along various scores. A similar six sided bottom panel has side edges abutting against the adjacent inner walls of the main body. The construction of the bottom tab and glue flaps strengthens the container against collapsing. The one-piece design of the blank makes it impractical for economical manufacture.

U.S. Pat. No. 4,927,026 issued to Gossler on May 22, 1990 discloses a pallet box that can be folded on top of the pallet. A pair of overlying floor boards with folding end flaps are attached to the pallet. The knock-down feature enables the box to lay down against the pallet and to make a very compact shape.

U.S. Pat. No. 4,948,035 issued to Wischoff on Aug. 14, 1990 shows a foldable hexagonal pallet container. A plurality of locking flaps are arranged in overlapping interlocking relation. The device is essentially a produce box suitable for light-weight loads. It must be manually unfolded and manually locked, as it is not self locking.

U.S. Pat. No. issued 4,976,353 to Halliday on Dec. 11, 1990 discloses an analogous, square pallet box container with a base that is secured to the pallet. Several elongated tabs depending from the base can be foldably engaged with a slot to secure the container on top of the pallet. The box adheres to the pallet by means of a flap that is cut and folded in such a way to flow through and under the contained product.

U.S. Pat. No. 5,484,100 issued to Rigby Jan. 16, 1996 depicts a paperboard carton with an automatic bottom. A peeling feature that allows the consumer to remove the carton from the product in a continual, spiral strip. The lack of a bottom structural flap limits the effectiveness of this design in holding products.

U.S. Pat. No. 5,715,991 issued to Gasper on Feb. 10, 1998 shows a multi-side, polygonal pallet box of the type known as a bellows-fold bottom in the industry. Flaps are folded within the container when the container is in a folded-flat condition, but automatically form an operative bottom structure when the flatly-disposed container is subsequently unfolded and deployed. This design lacks modern self-locking mechanisms. Furthermore, during erection the box must be manually turned upside down for proper folding.

U.S. Pat. No. 5,775,571 issued to Edelman on Jul. 7, 1998 shows a foldable, multi-sided pallet box that automatically "pops up" during folding. During deployment various tabs pop into proper alignment as flat sidewalls are squeezed towards each other. This six-sided design has a six-sided bottom that folds outwardly when pushed down.

U.S. Pat. No. 5,921,465 issued to Garton Jul. 13, 1999 shoes an octagonal pallet box that can be manually deployed from an initial flat condition. The floor blank is attached to a separate main blank by external connecting flaps disposed about the lower perimeter of the box walls. Although this device is self locking, experience has shown that the design is rather hard to erect. Further, this type of design is not practical to make on a standard industrial corrugator.

SUMMARY OF THE INVENTION

This invention provides a foldably deployable, heavy-duty pallet box for containing a variety of products that are normally handled with palletized loads. My new container provides a bulk packaging solution that is readily capable of reliably handling large loads of products such as deboned meats, liquids and other bulky and heavy items. All can be safely handled and constrained.

Preferably, the container is made from two identical, but complementary blanks that form a single board that foldably forms the desired pallet container. Preferably each blank comprises various foldable panels and corresponding regions to which complementary panels are affixed. Alternatively, the board may comprise a larger, unitary blank comprising similar complementary halves. When blanks are glued together in proper alignment, and the box deployed, a spring effect occurs-larger loads tend to maintain the pieces together and preserve box integrity. Because of the flap constructions, and the mode of gluing during manufacturing, a strong and resilient pallet box is provided. The larger the box, the better the spring effect.

In the best mode, twin, complementary, die-cut, corrugated blanks are fitted together to form the board that folds into the desired pallet box. Each blank comprises a central side panel and a pair of bordering side panels separated by score lines for folding. A number of flaps project from each blank to enable construction. A lower, generally trapezoidal segment is formed at each blank bottom, beneath the central panel. The latter segments, one from each of two blanks, are coupled to form the knockdown bottom of the desired foldable container. Smaller trapezoidal flanges project downwardly from each blank at opposite sides of the larger trapezoidal segment. When assembled, the flanges form a shelf that braces the container bottom, reinforcing the knockdown structure. In the best mode each blank is identical.

Thus, a basic object of my invention is to provide a rugged and durable container for use with heavy articles that are to be shipped or moved about on pallets.

Another general object is to provide a pallet box that deploys from a flat state simply by unfolding.

It is also an important object to provide a pallet box useful for bulk packaging, specifically the handling of liquid products or boneless meat products.

A related object is to provide a heavy-duty pallet box of the character described that can be made from inexpensive corrugated material.

Another object of my invention is to provide a foldable pallet carton of the character described that occupies minimal volume space during storage.

A still further object is to provide a pallet box of that can be quickly and easily deployed by a single workman in a minimum amount of time.

A related object is to provide a foldably deployable pallet box of the character described that can be properly deployed without special tools or equipment.

Another important object is to provide a foldable pallet box of the character described that can be safely used with pallets, and that will safely handle the various shocks and jarring movements imparted by typical fork-lift trucks.

Thus a related object is to provide a pallet box that when deployed, is rugged enough for use with pallets in a relatively harsh industrial environment, but which is flexible enough to be quickly erected from a flat, folded, storage state.

Another important object is to provide a heavy-duty pallet box of the character described that is safe for use in a typical industrial warehouse scenario.

Concurrently, an important object is to provide a pallet box that minimizes shipping costs and expenses.

Another object is to provide a pallet box that is suitable for the reliable transportation of large quantities of flowable solids.

Yet another important object is to provide a pallet box of the character described that does not have to be upside-down during the unfolding and deployment process.

Yet another object of my invention is to provide a geometric design for a pallet box that can safely employed with a variety of sizes and weight-bearing capacities. It is a feature of my design that pallet loads of up to 2400 pounds can be safely constrained.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 3:
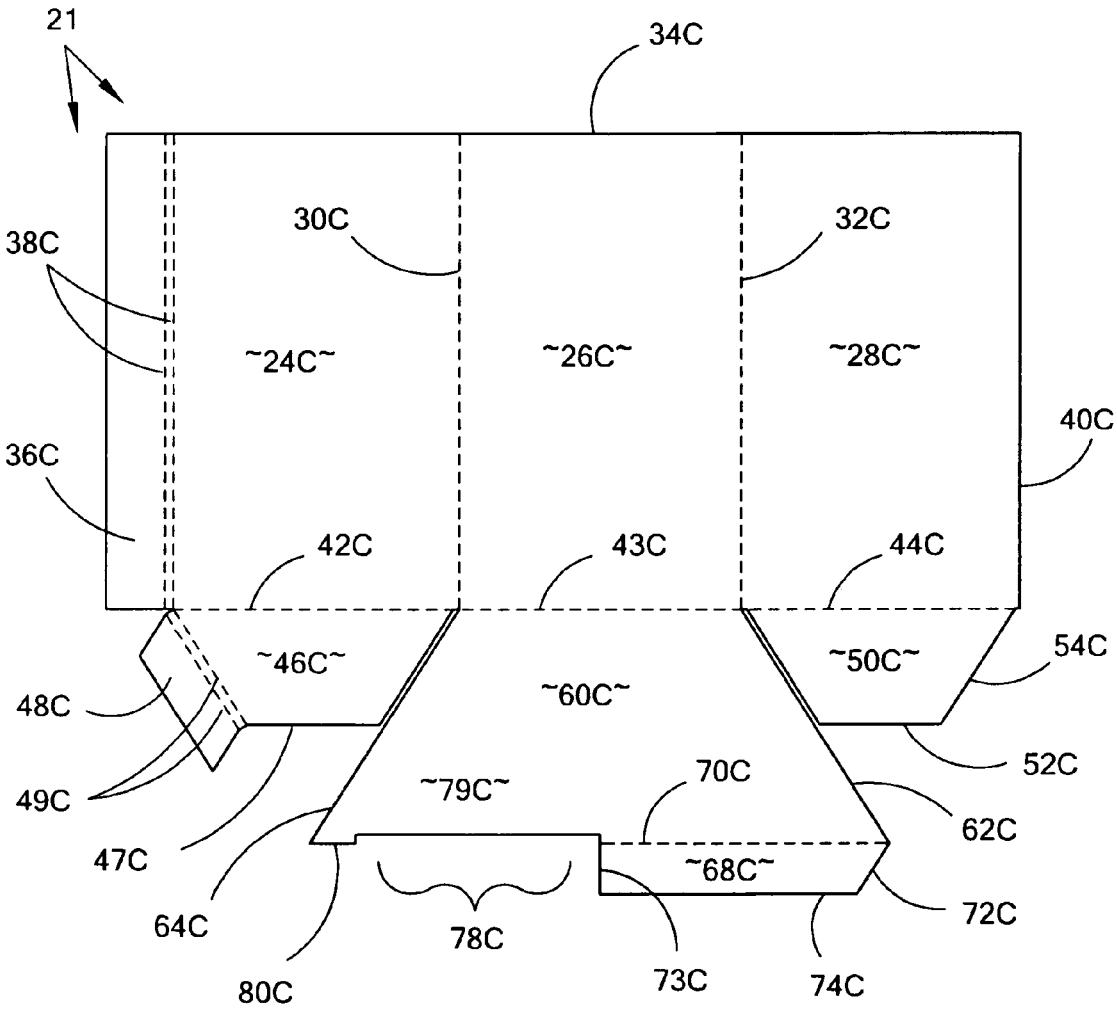
FIG. 3 is a top plan view of a preferred, complementary blank.
Figure 4:
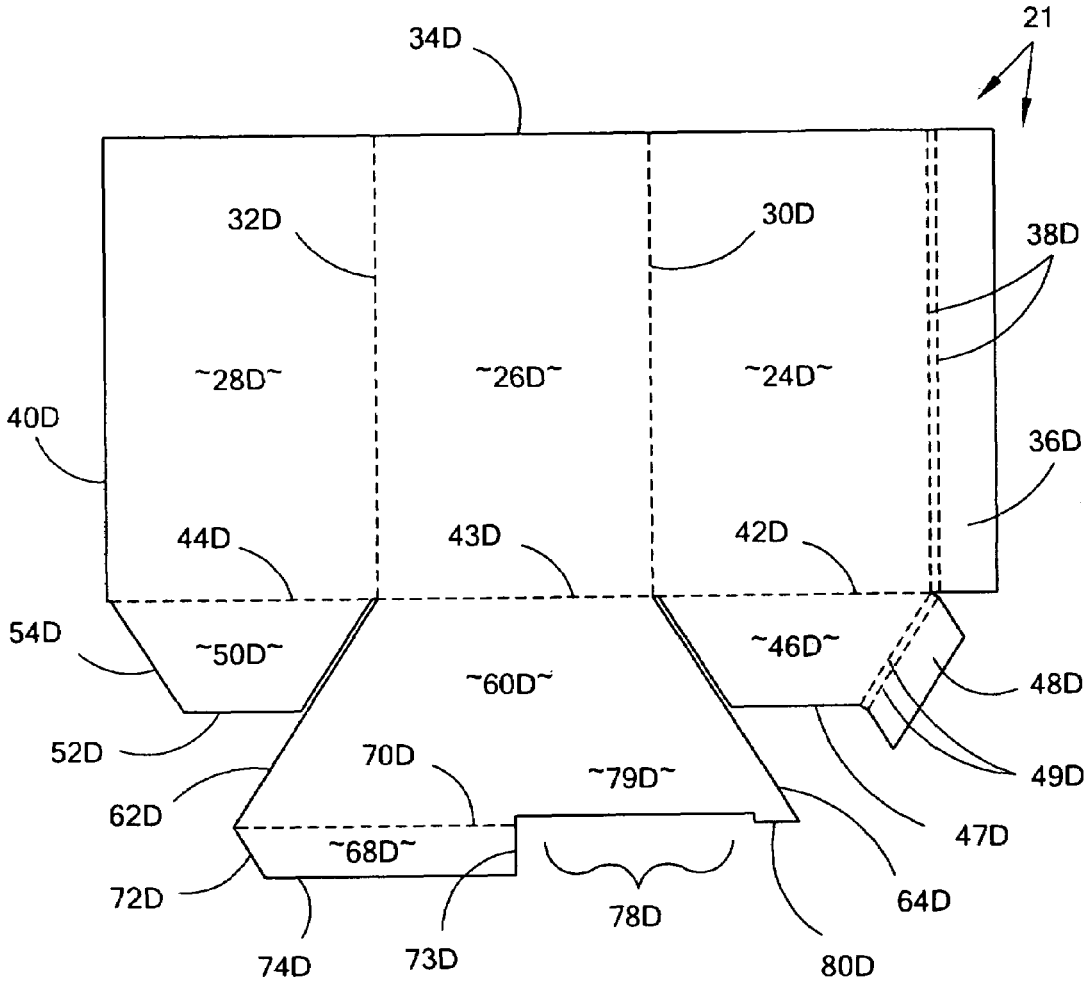
FIG. 4 is a bottom plan view of the complementary blank of FIG. 3.
Figure 12:
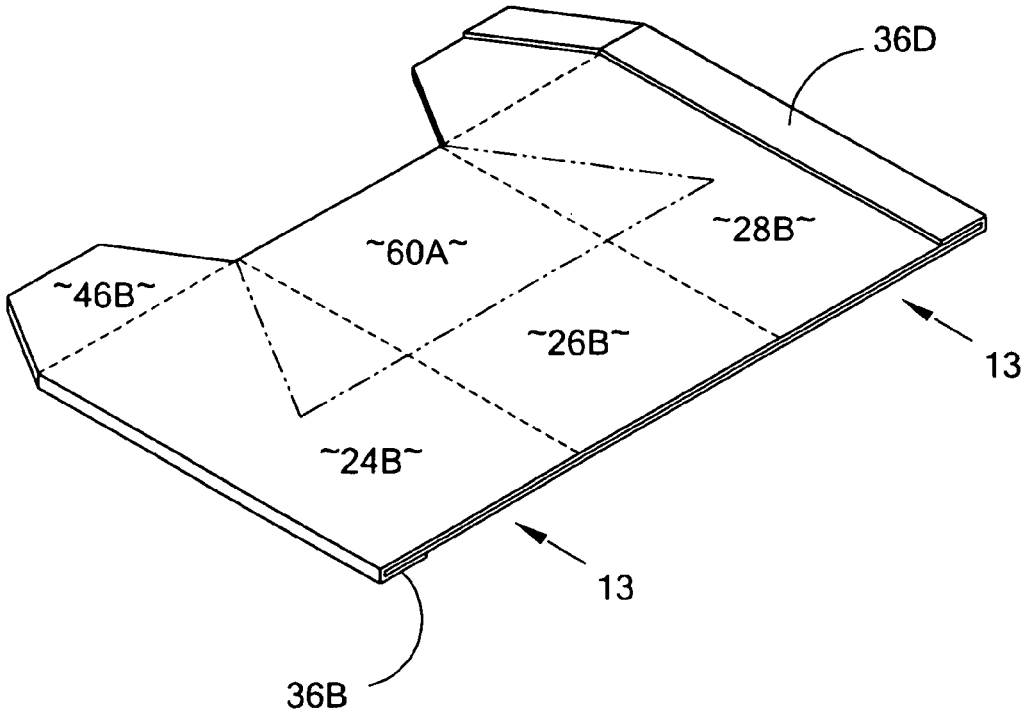
FIG. 12 is an isometric view of the flattened board of FIGS. 10 and 11 showing all flaps glued, with the resultant board disposed in a flat shipping or storage state.

With initial reference directed now to FIGS. 1-6 of the appended drawings, preferred complementary blanks 20, 21 are illustrated. In the best mode blank 20 (FIGS. 1-2) is identical to complementary blank 21 (FIGS. 3-4). The preferably identical, multi-component blanks 20, are coupled together as described hereinafter and appropriately glued together to form a preferred board 22 (i.e., FIGS. 5, 6) which may be stored in a compact, flat position (i.e., FIG. 12) and thereafter unfolded as in FIGS. 13-15 into the deployed, polygonal pallet carton 27 of FIG. 16.

For purposes of simplifying this discussion and the associated drawings and disclosure, all common parts of the illustrated blanks 20, 21 have been designated with similar reference numerals that differ only in their suffix. This top portions of blank 20 (FIG. 1) have been given the suffix "A," and the corresponding bottom portions (i.e., the same parts as they appear from the underside of the blank) have been given the suffix "B" in FIG. 2. Likewise, in FIG. 3 identical structural parts visible from the top complementary blank 21 have been designated with the suffix "C"; those same parts visible from the underside of blank 21 have been designated with the reference numeral "D" (FIG. 4).

In the best mode the board 22 is formed from a pair of identical, complementary blanks 20 and 21 that are fitted and fastened together as hereinafter described. Alternatively, it will be recognized that a single board comprising a pair of halves substantially identical with blanks 20, 21 may be employed, but this approach results in a larger basic blank that increases tooling costs. As used herein the term "blank" is thus intended to refer not only to the preferred two-piece mode, wherein board 22 comprises a pair of complementary blanks, but to a single piece board or blank comprising symmetrical halves, each resembling a blank 20, or 21. In any event, the blanks or boards are preferably die-cut from heavy-duty corrugated material, although other sheet-like components like paperboard, cardboard or the like known to those with skill in the art can be used. During assembly when a pair of blanks 20, 21 are glued together the resulting boards 22 are flat, and may be temporarily stored in a stacked relationship for volumetric efficiency. A single workman may appropriately fold boards, and they need not be turned upside-down during deployment.

Figure 1:
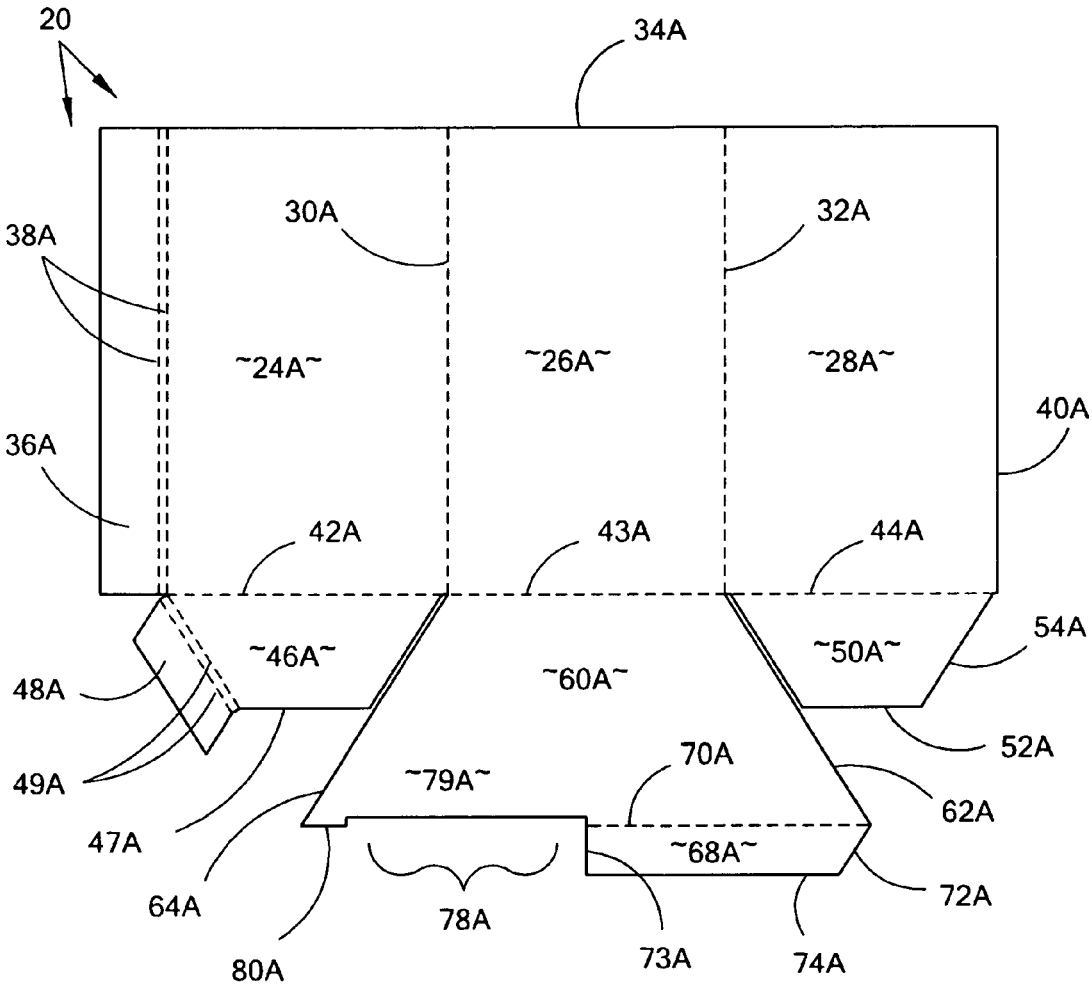
FIG. 1 is a top plan view of a preferred blank that is glued to an identical, complementary blank to produce the preferred board.
Figure 2:
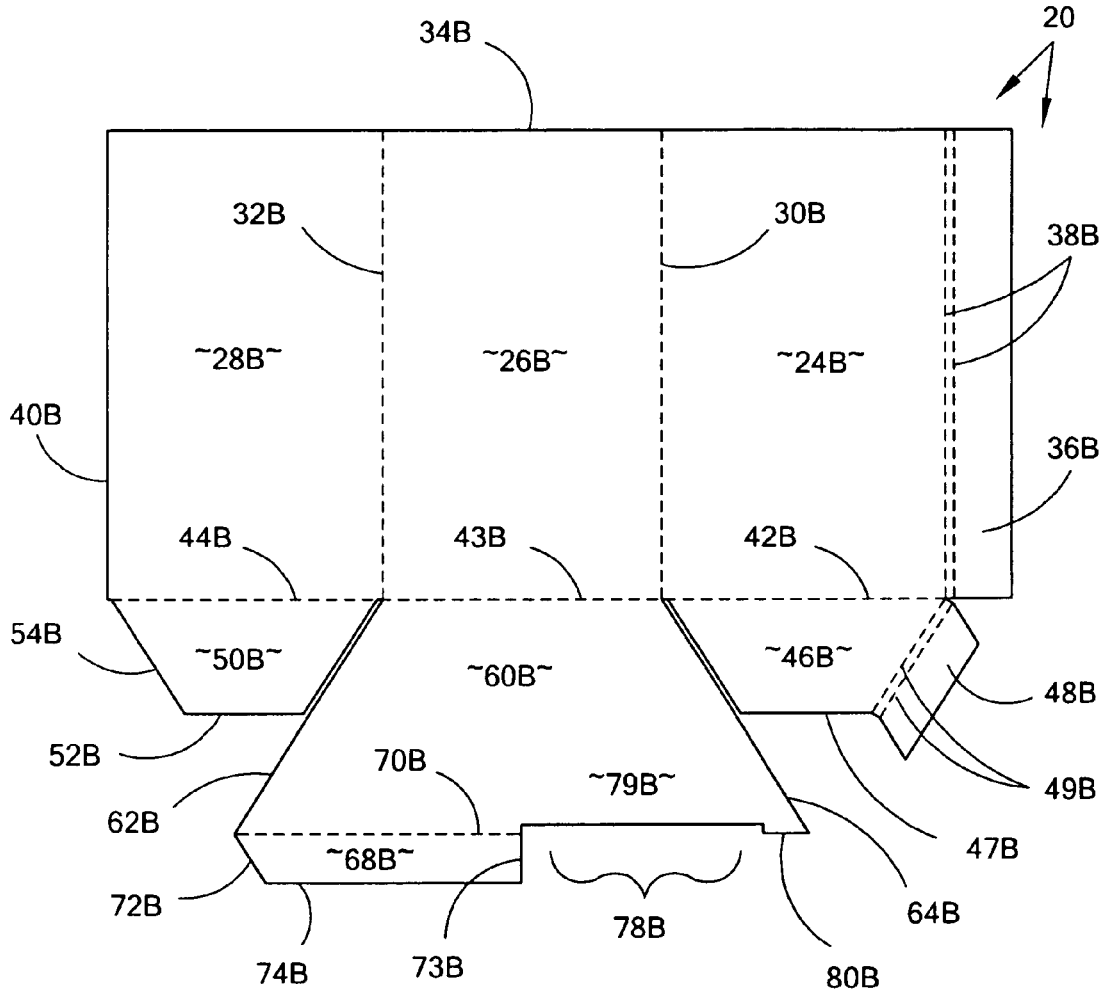
FIG. 2 is a bottom plan view of the preferred blank of FIG. 1.

A preferred blank 20 comprises an upper generally rectangular region comprising separate, smaller rectangular panels: a gluing side panel 24A, an adjacent, central side panel 26A, and an adjacent, integral receiving side panel 28A (FIG. 1). A vertical score line 30A divides and foldably separates panels 24A, 26A. A similar, spaced apart, score line 32A foldably separates adjacent panels 26A, 28A. Panels 24A, 26A, and 28A will form sides of the deployed and erected polygonal container 27 (FIG. 16) along with similar corresponding panels 24C, 26C, 28C of complementary blank 21 (FIGS. 3, 4). The top of blank 20 is designated by the reference numeral 34A. A generally rectangular gluing flap 36A that is integral with and adjacent gluing side panel 24A is separated therefrom by vertical, double score lines 38A. The opposite terminal edge of the blank 20, bounding receiving panel 28A, has been designated by the reference numeral 40A, and in the best mode there is no flap there.

Figure 17:
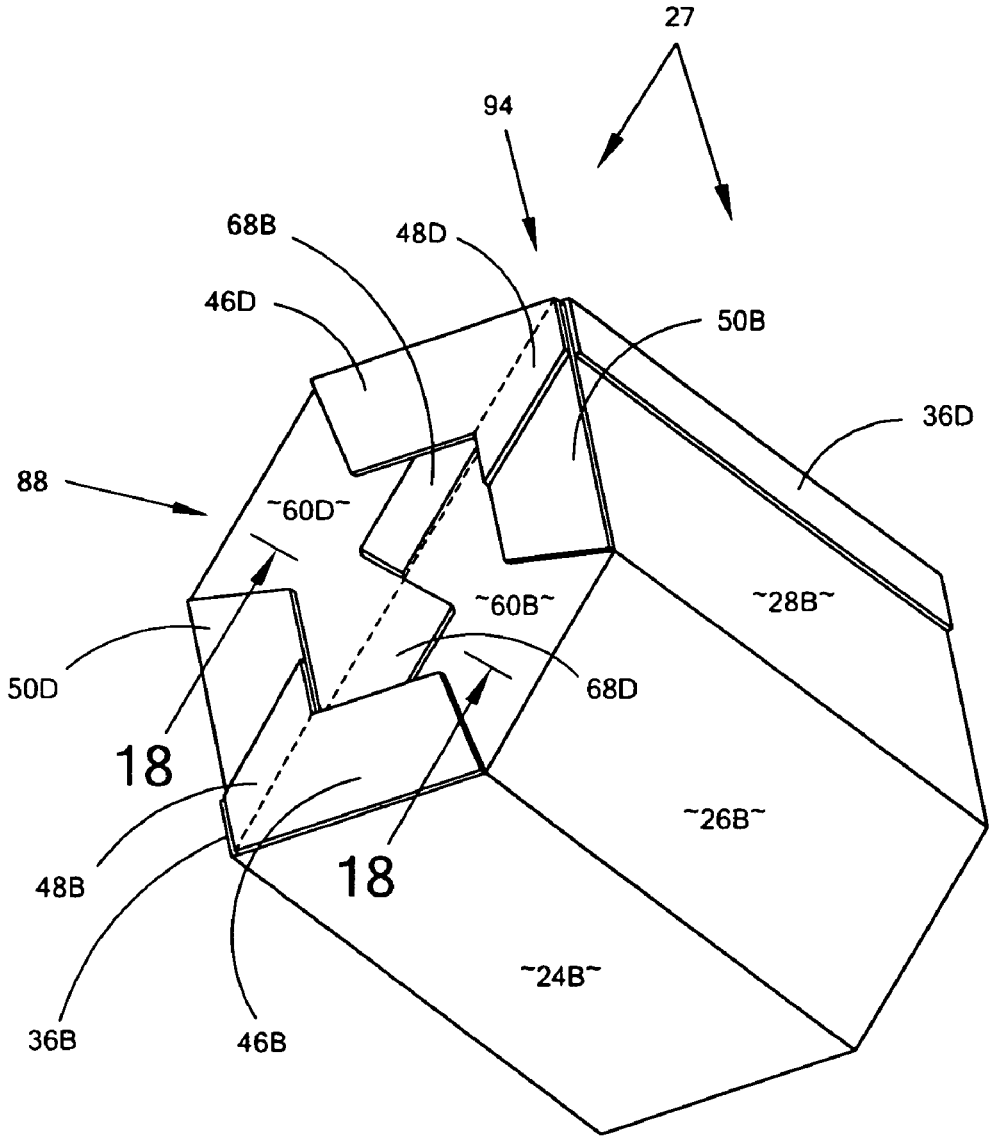
FIG. 17 is a bottom isometric view of the deployed container of FIG. 16; and, FIG. 18 is an enlarged fragmentary isometric view taken generally from a position along line 18-18 of FIG. 17.
Figure 18:
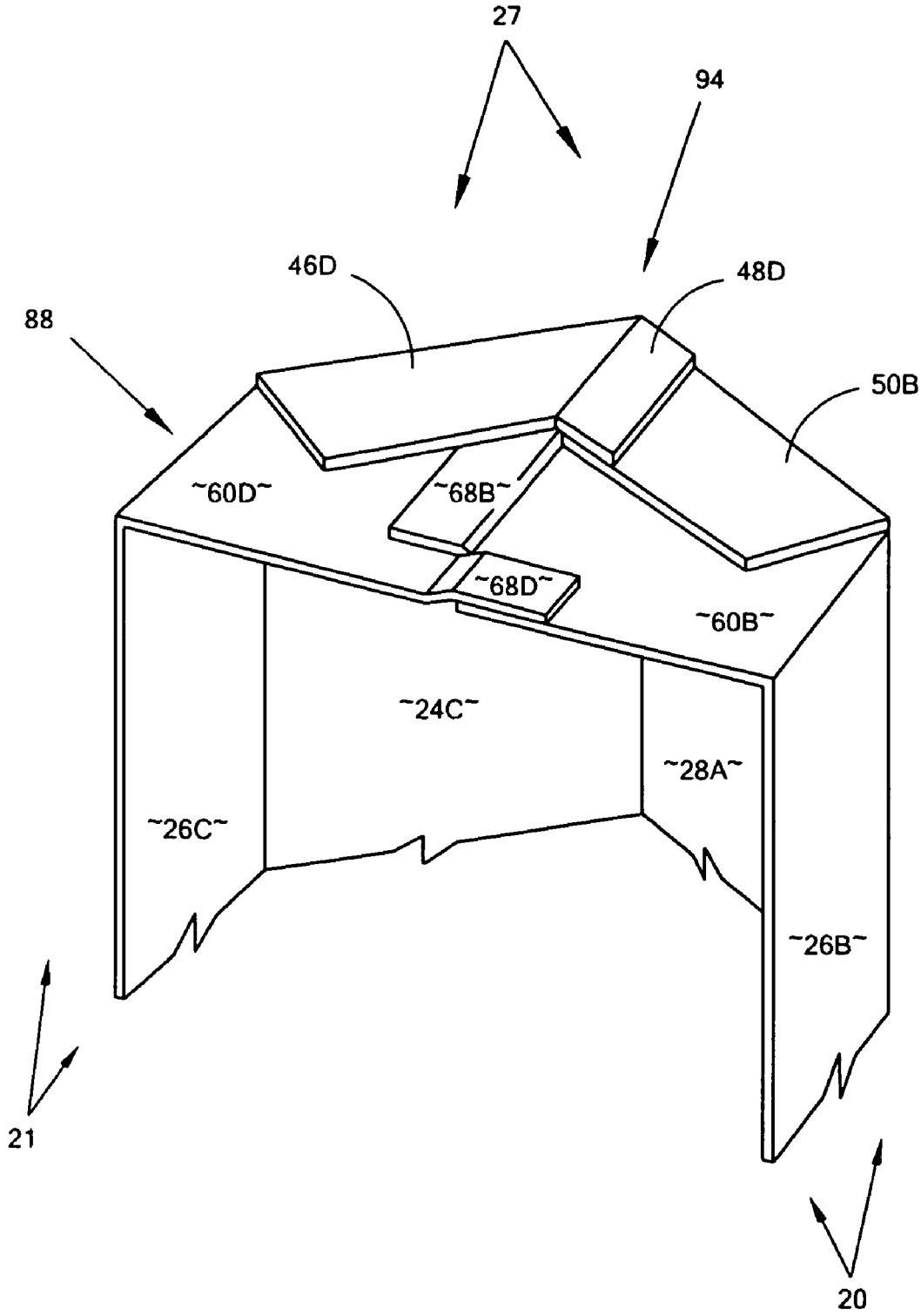

A trio of axially aligned, contiguous horizontal body score lines 42A, 43A, and 44A respectively adjoin the bottoms of panel 24A, 26A, and 28A. A first, generally trapezoidal flange 46A is separated from the bordering side panel 24A by score line 42A. The bottom edge of flange 46A is designated generally by the reference numeral 47A. Flange 46A supports an outer, integral glue flap 48A that is separated by inclined, double score lines 49A. Similarly, there is a second generally trapezoidal, flange 50A separated from bordering receiving panel 28A by score line 44A. The bottom of flange 50A is designated by the reference numeral 52A. The angled, outer edge of flange 50A is designated by the reference numeral 54A. As described later in more detail, flanges from the various coupled-together blanks form reinforcement shelves for bracing the bottom of the container when erected. It should be noted that in the best mode there is no glue flap formed along edge 54A of flange 2350A. The flanges (i.e., 46A, 46B, 46C, 46D and 50A, 50B, 50C, and 50D) form a supporting shelf that reinforces the container bottom, as will later be described in conjunction with a description of FIGS. 17-18.

Importantly there is a relatively large, generally trapezoidal segment 60A formed at the panel bottom, beneath score line 43A and the integral, adjoining central panel 26A. The purpose of trapezoidal segments 60A/60B and 60C/60D is to form a heavy-duty bottom for the pallet container, when the blanks 20, 21 are coupled, and the resulting board is unfolded. Segment 60A has a first outer inclined edge 62A that is cut away from adjoining flange 50A, 1 and a second, spaced-apart, inclined edge 64A that is cut away from adjoining flange 46A. A generally rectangular bottom glue flap 68A is formed adjacent score line 70A at the bottom of trapezoidal segment 60A. In the best mode, the glue flap 68A has an inclined edge 72A, a spaced apart vertical edge 73A, and a bottom edge 74A extending between edges 72A and 73A. The length of glue flap 68A (i.e., corresponding generally to score line 70A in FIG. 1) is approximately one half of the length of the bottom of trapezoidal segment 60A. Importantly, there is a relief cut 78A bordering glue flap 68A at the bottom left of segment 60A (i.e., as viewed in FIG. 1). The relief cut 78A is bounded by an offset alignment tab 80A occupying the extreme left bottom region of the trapezoidal segment 60A. There is a small, approximately rectangular glue reception region above relief cut 78A that has been generally designated by the reference numeral 79A. Reception region 79A will be glued to flap 68C on the complementary blank 21 in assembly.

Figure 5:
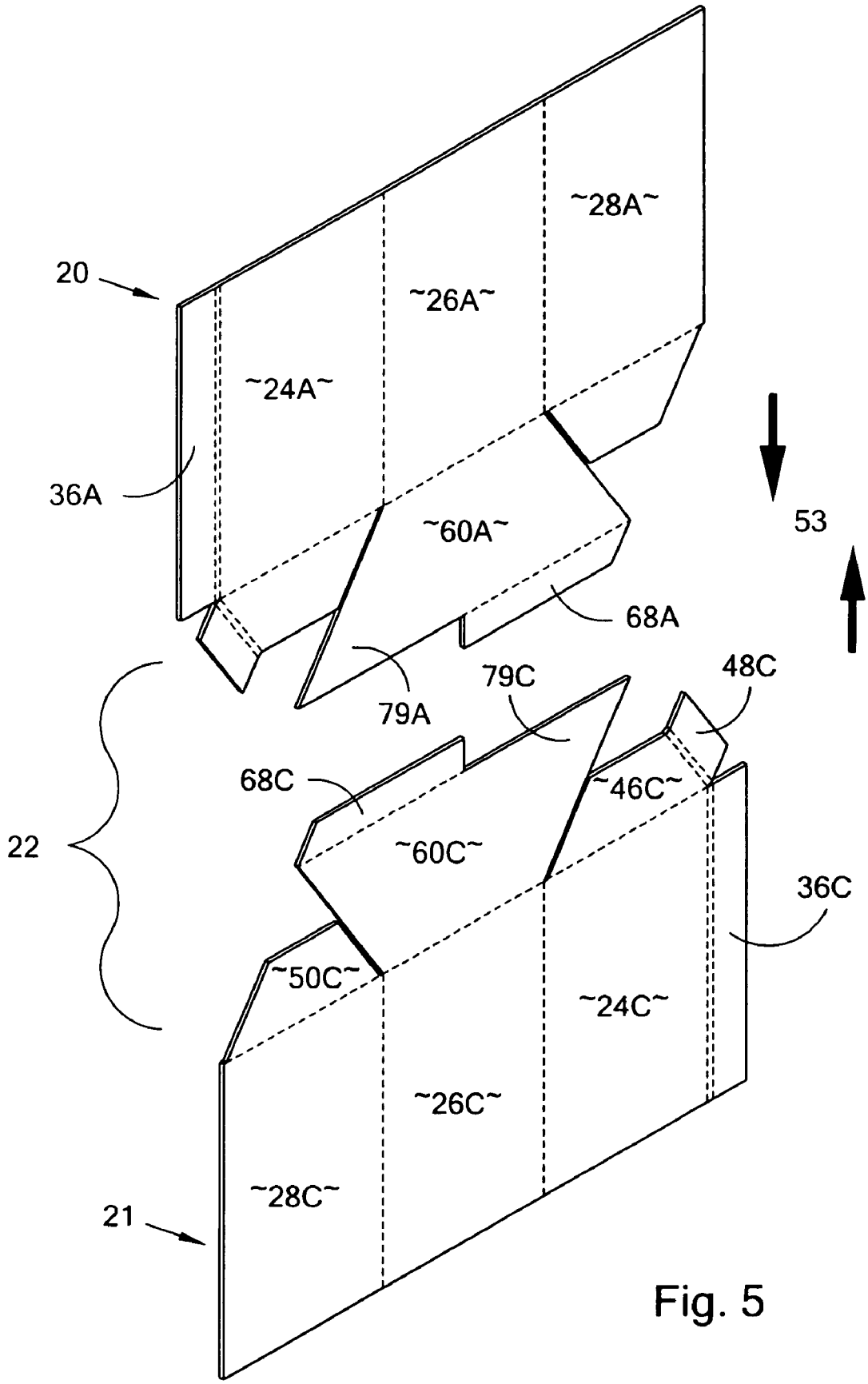
FIG. 5 is a diagrammatic and isometric view showing a pair of blanks aligned for proper assembly that are adapted to be glued together to form the desired board.
Figure 6:
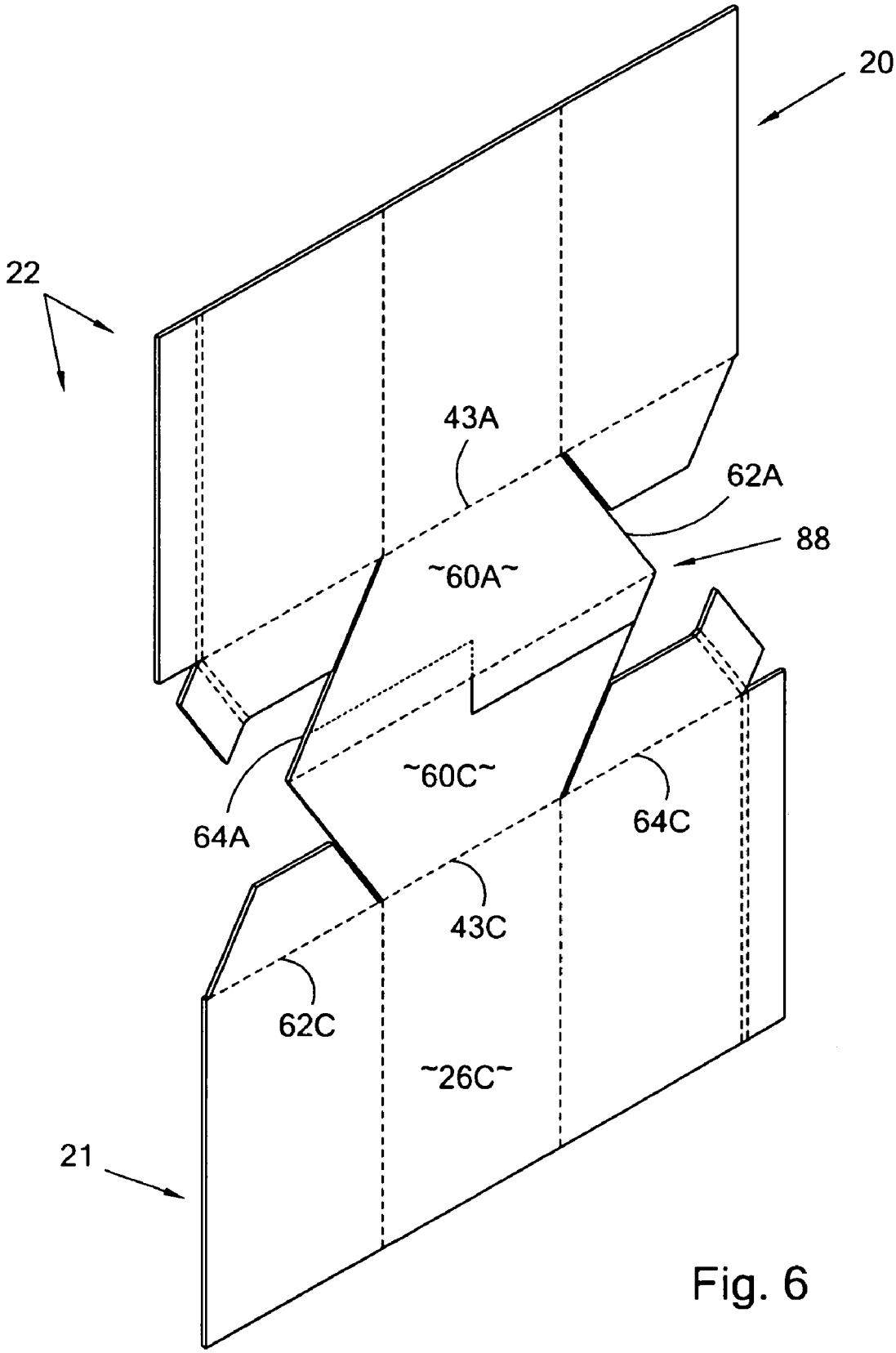
FIG. 6 is an isometric view of the assembled board, immediately after the complementary blanks are glued together.
Figure 7:
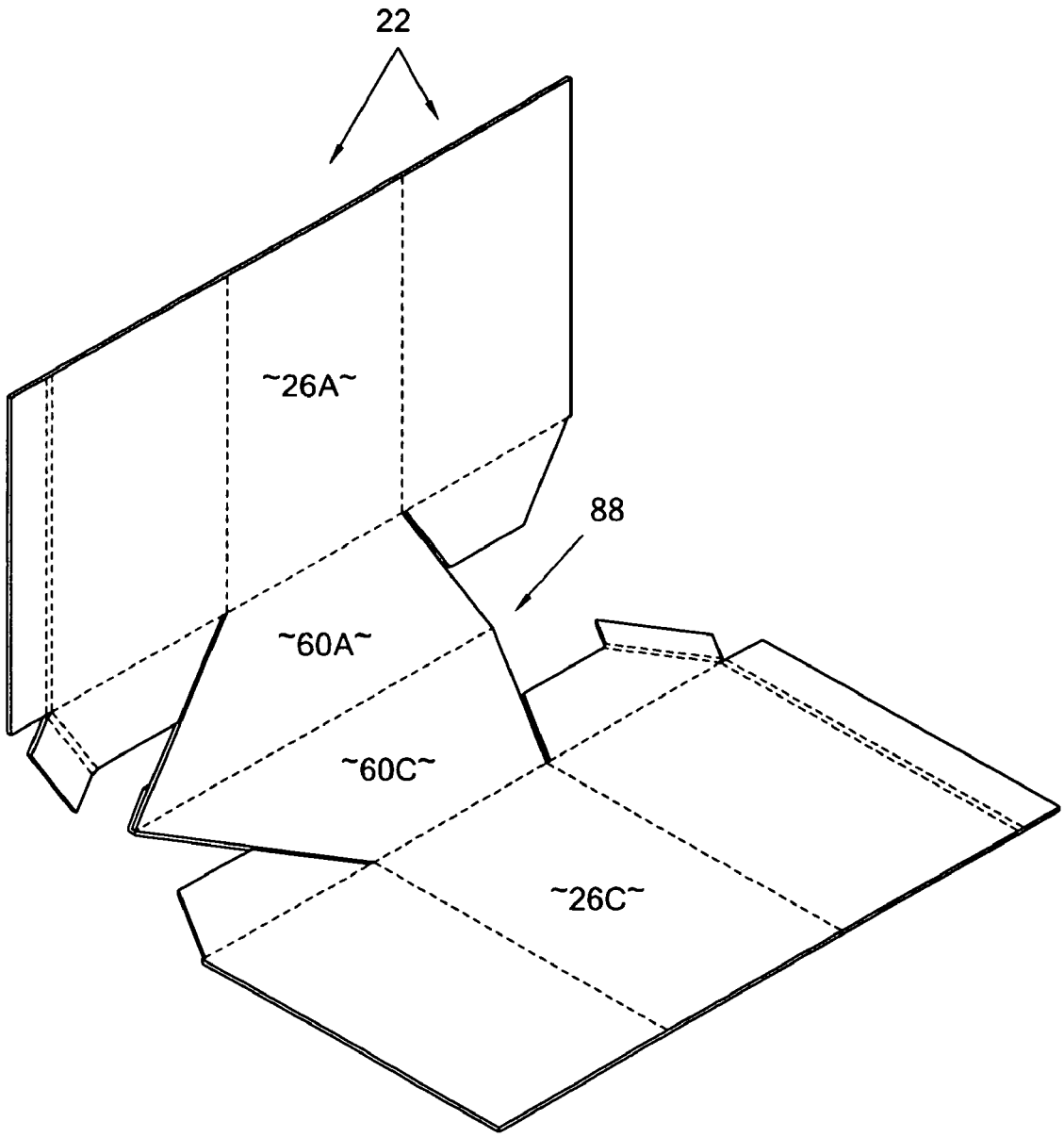
FIG. 7 is an isometric view of the assembled board showing a subsequent folding stage for assembly of the desired foldable box.
Figure 8:
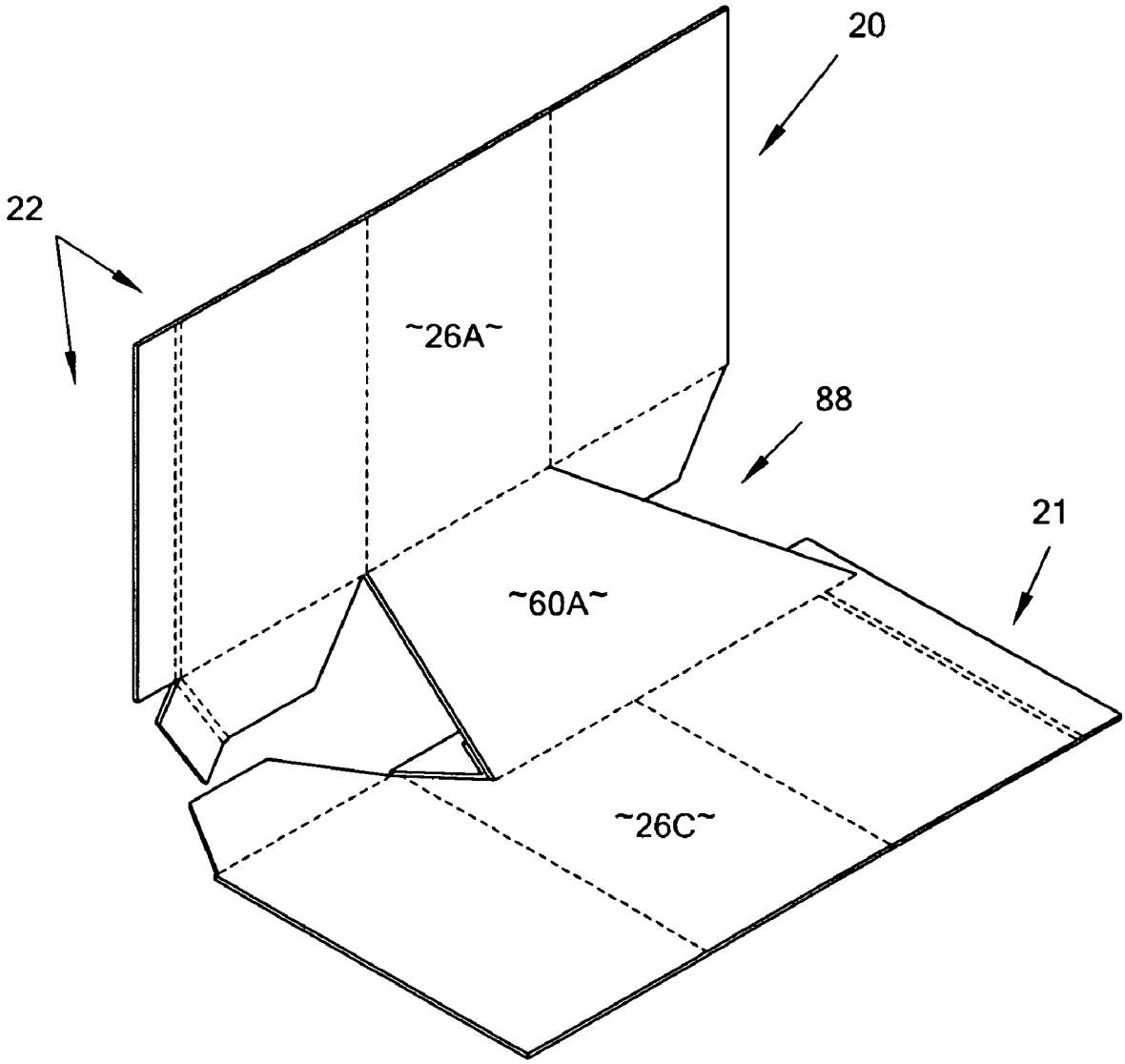
FIGS. 8 and 9 are isometric views showing subsequent folding stages.
Figure 9:
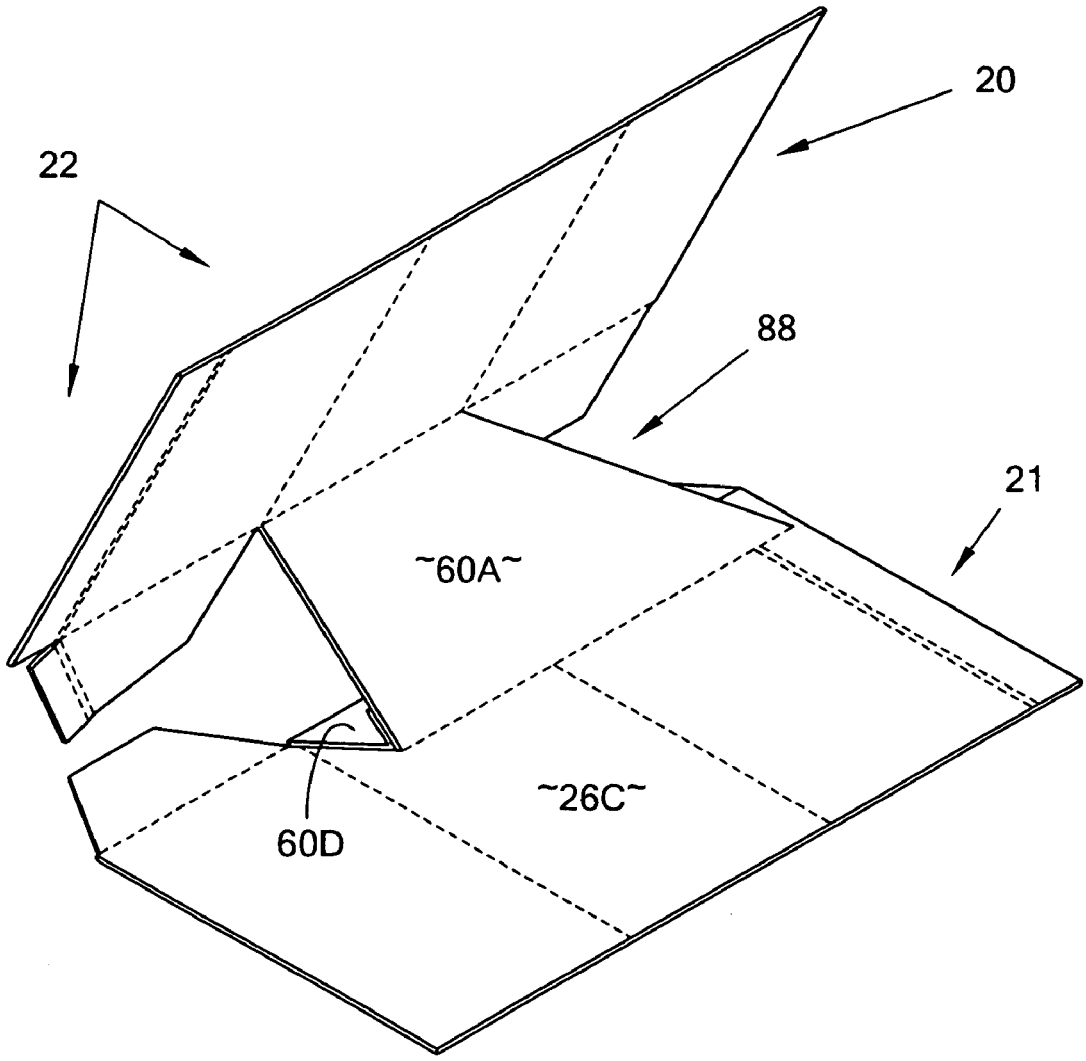
Figure 10:
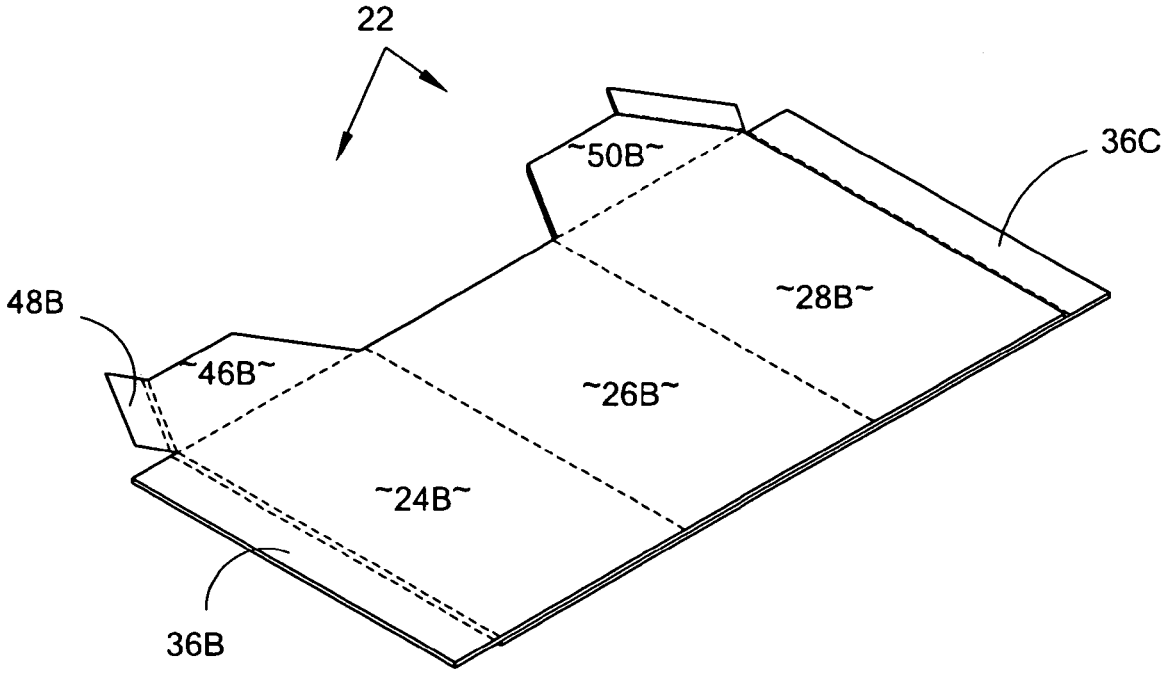
FIG. 10 is an isometric view of the partially-assembled and flattened board as it appears immediately after the partial folding steps of FIGS. 7-9.

Turning now to FIGS. 5 and 6, assembly of the desired board 22 starts by positioning a pair of complimentary blanks 20 and 21 substantially as illustrated. In FIG. 5, blank 20 is oriented substantially as seen in FIG. 1, but blank 21 is turned upside down from the position illustrated in FIG. 3. This orientation is assumed for purposes of illustration, as other starting orientations for blanks 20, 21 could be used. For example, blank 20 could be positioned on top of the Figure or at the bottom as oriented generally in FIG. 5, with either surface "A" or "B" facing the viewer, and blank 21 would be positioned accordingly). The first step in assembling board 22 is to mate the complementary trapezoidal, bottom-forming segments 60A, 60C by moving them together as represented of arrows 53 (FIG. 5). When this occurs, 79A flange 68C (more particularly the bottom flange side 68D not seen in FIG. 5) will be glued to region 79A on flange 60A. Similarly, the underside of flap 68A (more specifically 68B) will be glued to glue receptive region 79C on trapezoidal bottom-forming segment 60C. A hexagonal container bottom, generally designated by the reference numeral 88 (FIGS. 13-15) results. Bottom 88 comprises the trapezoidal segments 60A/60B and 60C/60D as discussed earlier.

Figure 11:
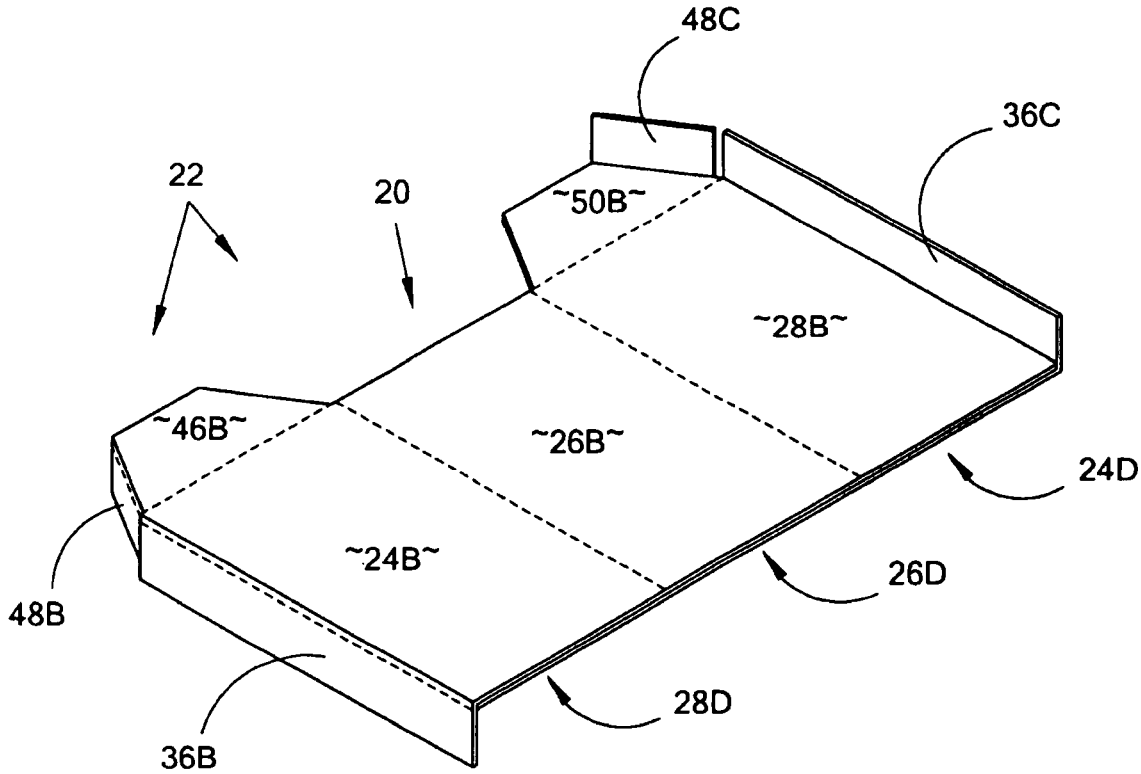
FIG. 11 is an isometric view of the flattened board of FIG. 10 with certain flaps partially folded before gluing.

Once the bottom 88 is constructed as aforesaid, it is folded into a flat position, as in the sequence of FIGS. 7-10. Bottom 88 forms a triangular cross section with its apex projecting towards the viewer in FIGS. 8 and 9. Finally the two blanks 20, 21 are pressed together, and bottom 88 (FIGS. 13-15) will be flatly folded and nested together, projecting into the interior as in FIG. 10, with trapezoidal segment 60B touching the surface of trapezoidal segment 60D. At this time gluing flap 36B is turned over and glued to panel 28D (i.e., the underside panel of blank 21), as indicated sequentially in FIGS. 10-12. Similarly, glue panel 36C/36D (FIGS. 10-12) is folded over and glued to the edge region of surface 28B. The flange glue flap 48B (FIG. 11) is folded over glued to flange 50D (i.e., surface 48A thereof is glued to flange 50D). Concurrently glue flap 48C is glued to flange 50B, forming the configuration of FIG. 12. These construction steps need be performed only approximately in order. Different portions of the blanks could be glued together in different sequences. Completion of these gluing steps yields a flatly folded container 27 that is constructed in accordance with the best mode of the invention.

Figure 13:
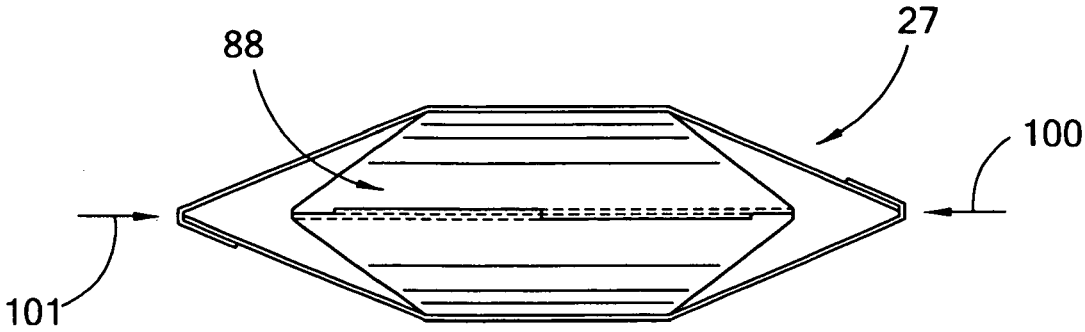
FIGS. 13-15 show are elevational views taken generally from the position indicated by reference arrows 13-13 in FIG. 12, showing how the desired container is formed by unfolding the previous flat, constituent board.
Figure 14:
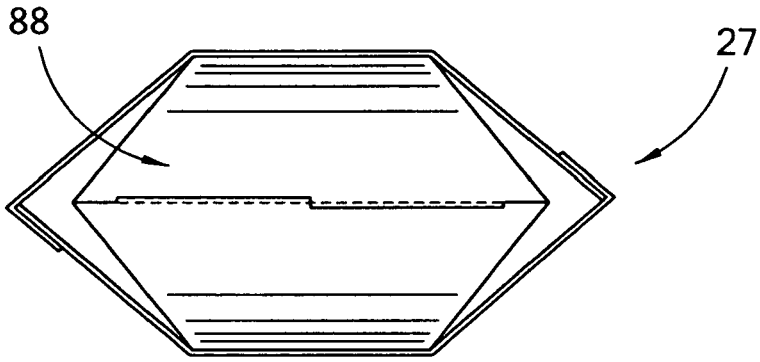
Figure 15:
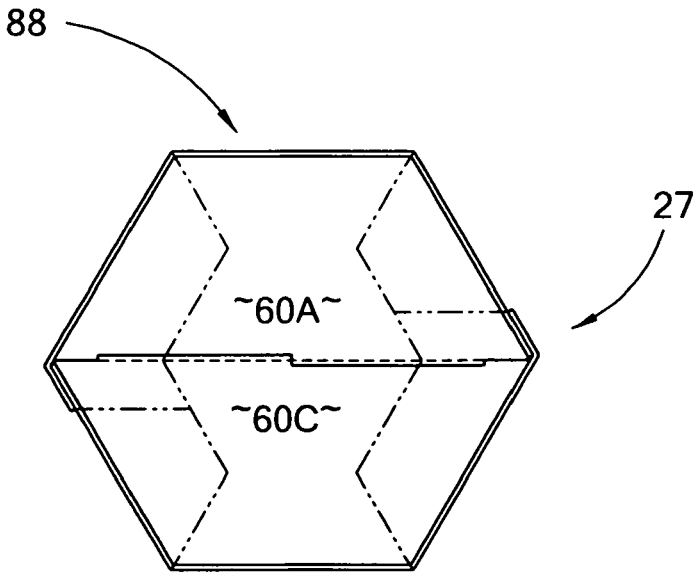
Figure 16:
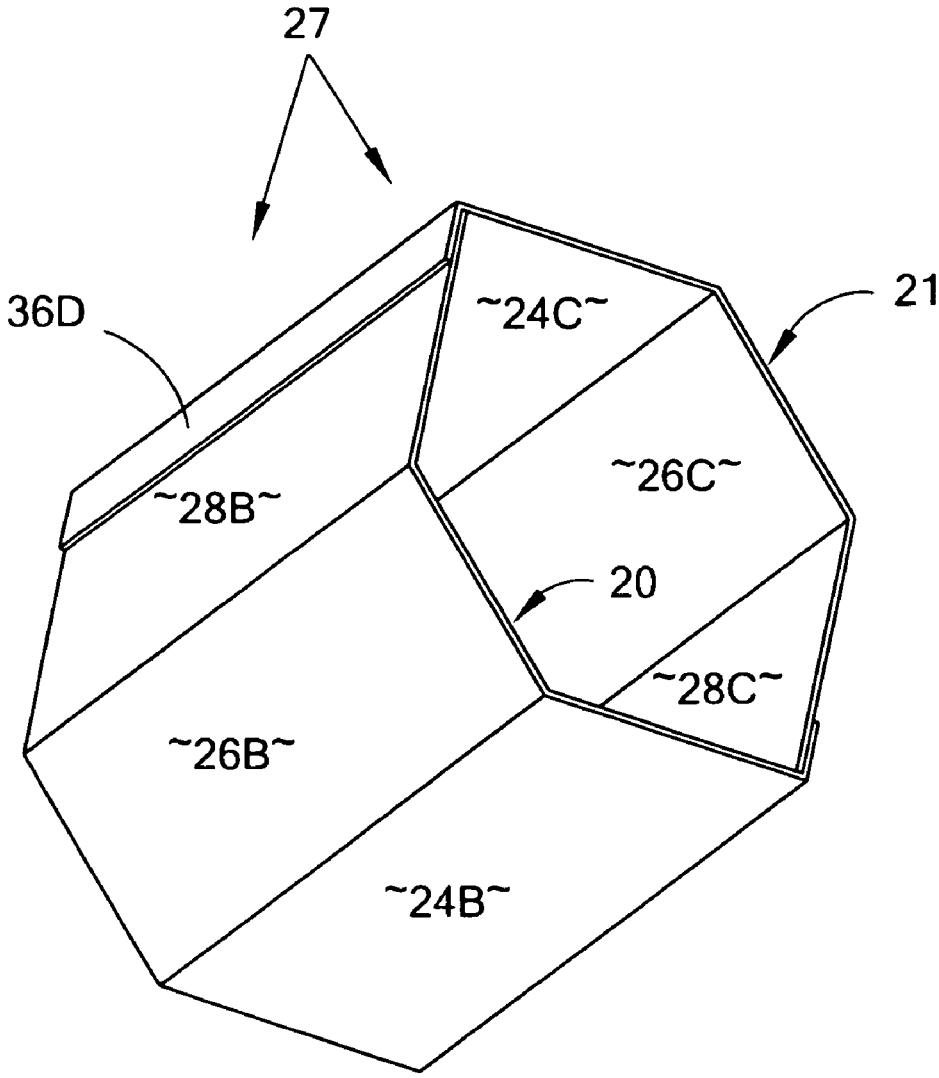
FIG. 16 is a top isometric view of the deployed container.

Turning to FIGS. 13-16, the folded, flat container 27 is erected by squeezing sideways, generally as indicated in the direction of arrows 100, 101 (FIG. 13. Additional pressure and deflection results in the hexagonal, deployed container 27 (FIGS. 15, 16). It is seen that the bottom 88 formed from the trapezoidal segments 60A/60B and 60C/60D is hexagonal in the preferred embodiment, i.e., the number of facets of the hexagon equals the number of sides of the deployed container. Importantly, a pair of spaced apart reinforcement shelves 94 are disposed beneath to bottom 88 of the deployed container 27 (these are best viewed in FIGS. 17 and 18 where they appear at the top of the views.) These twin spaced-apart reinforcement shelves result from the coupled-together trapezoidal flanges 46A/46B that mate with flanges 50C/50D, and from flanges 46*c*/46D that mate with flanges 50A/50B. As the pallet is loaded, downward pressure may tend to push down and deform bottom 88; however, when deflected, the bottom 88 contacts the shelves 94 that distribute pressure, reinforce the container, and tend to maintain its proper geometry and shape.

From the foregoing, it will be seen that this invention is well adapted to obtain all the ends and objects herein set forth, together with other advantages inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A heavy duty, knockdown container that is transformable between a flat, compact orientation for storage and shipping and a deployed configuration for containing goods, the container formed from a pair of substantially identical complementary blanks that are coupled to one another, wherein each blank comprises:

a generally rectangular gluing side panel having a top, a pair of sides and a bottom;

an integral, generally rectangular central side panel adjacent said gluing side panel, the central side panel having a top, a pair of sides and a bottom;

a folding line defined between said central side panel and said gluing side panel;

an integral receiving side panel adjacent said central side panel, the receiving side panel having a top, a pair of sides and a bottom;

a second folding line defined between said central side panel and said receiving side panel;

a generally rectangular gluing flap foldably defined adjacent said gluing side panel for attaching the gluing side panel on a first blank to the receiving side panel on a complementary blank;

a generally trapezoidal segment foldably coupled to said central side panel at the bottom thereof for mating with a similar trapezoidal segment of the complementary blank to form a foldable polygonal bottom of said container, the trapezoidal segment comprising a bottom glue flap, a spaced apart relief slot, and a glue reception region proximate the relief slot that foldably mates with the bottom glue flap on the trapezoidal segment of a complementary blank;

a first, generally trapezoidal flange foldably disposed at the bottom of said gluing side panel which contiguously borders and is separated from said trapezoidal segment, the first trapezoidal flange comprising an integral, adjacent, foldable flange glue flap; and, a second, generally trapezoidal flange foldably disposed at the bottom of said receiving side panel which contiguously borders and is separated from said trapezoidal segment for coupling to the foldable flange glue flap of a first trapezoidal flange associated with a gluing side panel of a complementary blank thereby forming a foldable shelf disposed beneath the container bottom for reinforcing the container bottom when the container is deployed.

2. The container as defined in claim 1 further comprising an alignment tab disposed adjacent the relief slot of each trapezoidal segment.

3. A heavy duty, hexagonal container that is transformable between a flat, compact orientation for storage and shipping and a deployed configuration for containing goods, the container formed from a pair of substantially identical complementary die-cut blanks that are coupled to one another, wherein each blank comprises:

a generally rectangular gluing side panel having a top, a pair of sides and a bottom;

an integral, generally rectangular central side panel adjacent said gluing side panel, the central side panel having a top, a pair of sides and a bottom;

a folding line defined between said central side panel and said gluing side panel;

an integral receiving side panel adjacent said central side panel, the receiving side panel having a top, a pair of sides and a bottom;

a second folding line defined between said central side panel and said receiving side panel;

a generally rectangular gluing flap foldably defined adjacent said gluing side panel for attaching the gluing side panel on a first blank to the receiving side panel on a complementary blank;

a generally trapezoidal segment foldably coupled to said central side panel at the bottom thereof for mating with a similar trapezoidal segment of the complementary blank to form a foldable polygonal bottom of said container, the trapezoidal segment comprising a bottom glue flap, a spaced apart relief slot, and a glue reception region proximate the relief slot that foldably mates with the bottom glue flap on the trapezoidal segment of a complementary blank;

a first, generally trapezoidal flange foldably disposed at the bottom of said gluing side panel which contiguously borders but is separated from said trapezoidal segment, the first trapezoidal flange comprising an integral, adjacent, foldable flange glue flap; and, a second, generally trapezoidal flange foldably disposed at the bottom of said receiving side panel which contiguously borders but is separated from said trapezoidal segment for coupling to the foldable flange glue flap of a first trapezoidal flange associated with a gluing side panel of a complementary blank thereby forming a foldable shelf disposed beneath the container bottom for reinforcing the container bottom when the container is deployed.

4. The container as defined in claim 1 further comprising an alignment tab disposed adjacent the relief slot of each trapezoidal segment.

* * * * *